US010220407B2

(12) United States Patent
Lin

(10) Patent No.: US 10,220,407 B2
(45) Date of Patent: Mar. 5, 2019

(54) APPARATUS FOR PROCESSING YARNS

(71) Applicant: Kuei Jung Lin, Taipei (TW)

(72) Inventor: Kuei Jung Lin, Taipei (TW)

( * ) Notice: Subject to any disclaimer, the term of this patent is extended or adjusted under 35 U.S.C. 154(b) by 0 days.

(21) Appl. No.: 15/456,590

(22) Filed: Mar. 13, 2017

(65) Prior Publication Data

US 2018/0258581 A1 Sep. 13, 2018

(51) Int. Cl.

| | |
|---|---|
| ***D06M 15/564*** | (2006.01) |
| ***B05C 9/10*** | (2006.01) |
| ***D02J 7/00*** | (2006.01) |
| ***D02J 1/06*** | (2006.01) |
| ***D02J 13/00*** | (2006.01) |
| ***D06M 15/507*** | (2006.01) |
| ***D06M 15/263*** | (2006.01) |
| ***D06M 13/148*** | (2006.01) |
| ***D06M 13/335*** | (2006.01) |
| ***D06M 13/144*** | (2006.01) |
| ***D06M 13/355*** | (2006.01) |
| ***D02G 3/02*** | (2006.01) |

(Continued)

(52) U.S. Cl.

CPC ..... *B05C 9/10* (2013.01); *D02G 3/02* (2013.01); *D02J 1/06* (2013.01); *D02J 7/00* (2013.01); *D02J 13/001* (2013.01); *D06M 13/144* (2013.01); *D06M 13/148* (2013.01); *D06M 13/335* (2013.01); *D06M 13/355* (2013.01); *D06M 15/263* (2013.01); *D06M 15/507* (2013.01); *D06M 15/564* (2013.01); *B05C 3/125* (2013.01); *B05C 3/132* (2013.01); *B05C 9/12* (2013.01); *B05C 9/14* (2013.01); *D02G 1/0293* (2013.01); *D02G 1/08* (2013.01)

(58) Field of Classification Search

CPC ..... D02G 1/0293; D02G 1/08; D02G 3/02; B05C 3/125; B05C 3/132; B05C 9/10; B05C 9/12; B05C 9/14; B05C 11/06; B05C 21/00; Y10S 118/18; Y10S 118/19; D06M 15/564; D06M 13/355; D06M 13/144; D06M 13/335; D06M 13/148; D06M 15/507; D06M 15/263; D02J 13/001; D02J 1/06; D02J 7/00

USPC ..... 118/420, 72, 67, 68; 57/32, 250, 257, 57/258–260, 295

See application file for complete search history.

(56) References Cited

U.S. PATENT DOCUMENTS 2,992,928 A * 7/1961 Magnuson ..... B65B 3/04 222/1

3,388,965 A * 6/1968 Garrett ..... B65H 71/007 26/2 R (Continued)

*Primary Examiner* — Laura Edwards

(57) ABSTRACT

An apparatus for processing yarns includes a first roller set for extending yarn beam; a node generator installed after the first roller set for forming node section of the yarn beam; a first cleaning chamber installed after the node generator for cleaning the yarn beams; a material chamber for adding additive to the yarn beam; a second roller set installed after the material chamber for extending the yarn beam; a first heating chamber installed after the second roller set for thermally setting additives to the yarn beam so that the additives are firmly secured to the yarn of the yarn beam; a third roller set installed after the heating chamber for controlling the heating time of the yarn beam in the first heating chamber; and a fourth roller set installed after the third roller set for winding the yarn beam to a desired shape.

13 Claims, 2 Drawing Sheets

(51) Int. Cl.

| | |
|---|---|
| *B05C 9/14* | (2006.01) |
| *B05C 3/132* | (2006.01) |
| *B05C 3/12* | (2006.01) |
| *D02G 1/02* | (2006.01) |
| *D02G 1/08* | (2006.01) |
| *B05C 9/12* | (2006.01) |

(56) References Cited

U.S. PATENT DOCUMENTS 5,353,820 A * 10/1994 Suhonen ..... A61C 15/042
132/200
6,018,859 A * 2/2000 Borzym ..... B05B 13/0618
228/147

* cited by examiner

APPARATUS FOR PROCESSING YARNS

FIELD OF THE INVENTION

The present invention relates to yarns, in particular to an apparatus for processing yarns.

BACKGROUND OF THE INVENTION

With the increment of population, resources of earth are reduced gradually, while demands for resources are increased day by day. Generally, conversion of energy will cause heat dissipation so as to deteriorate greenhouse effect. Ozone layer of the earth is destroyed. As a result, the ultraviolet ray is greatly enhanced so that environment becomes worse and worse.

Light and heat hurt people's bodies. Over amount ultraviolet ray and overheat temperature hurt skin and people's bodies. Currently, people wear functional clothes for avoiding dangers from ultraviolet ray and high temperature. Moreover, current used washing agents are so strong so as to destroy the functions of clothes in washing machines after several times of washing, such as 5 to 10 times of washing.

For far infrared ray warming clothes used in winter, fibers are added with mineral powders and then are made as yarns. However, the shapes of the yarns are fixed and thus they are easily to be replaced by new kinds of yarns. As a result the old yarns are not used and then deserted.

Therefore the inventor of the present invention thought to add additives to the yarns directly, such as additives of temperatures and light sensitive are added to the yarn so that people wearing the clothes made of the yarns are protected by the yarns. Furthermore, the clothes producer can add functions to the yarns when orders are receipt.

SUMMARY OF THE INVENTION

Accordingly, object of the present invention is to provide an apparatus for processing yarns, wherein yarns processed from above procedures have the property of additives added thereon. When the yarns are made as clothes, in dying process, the properties of the additives including heat absorption, color change due to light or temperature variation will be presented so that these properties will present in the clothes made of the yarns so that people wearing the clothes will feel cool, or feel color change due to light or temperature variations.

To achieve above object, the present invention provides an apparatus for processing yarns, comprising: a first roller set for extending yarn beam; a node generator installed after the first roller set for forming node section of the yarn beam; a first cleaning chamber installed after the node generator for cleaning the yarn beams; a material chamber for adding additive to the yarn beam; a second roller set installed after the material chamber for extending the yarn beam; a first heating chamber installed after the second roller set for thermally setting additives to the yarn beam so that the additives are firmly secured to the yarn of the yarn beam; a third roller set installed after the heating chamber for controlling the heating time of the yarn beam in the first heating chamber; and a fourth roller set installed after the third roller set for winding the yarn beam to a desired shape.

DETAILED DESCRIPTION OF THE INVENTION

Figure 1:
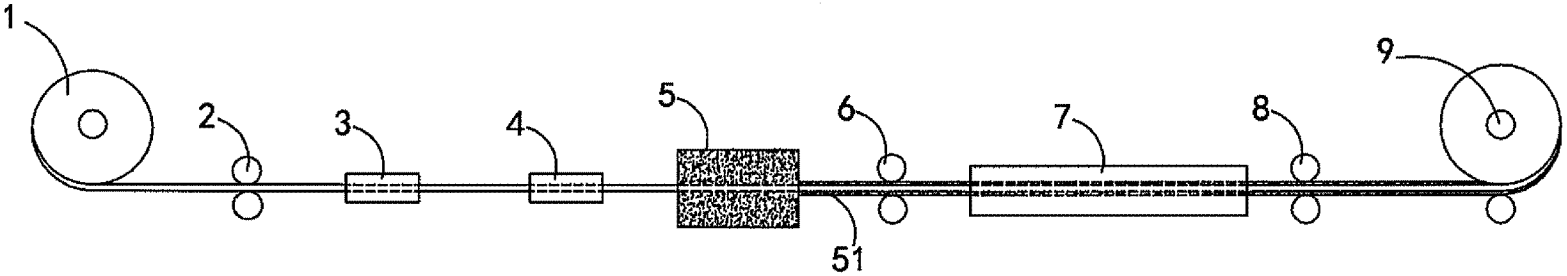
FIG. 1 is a schematic view showing the structure about the process of the present invention.
Figure 2:
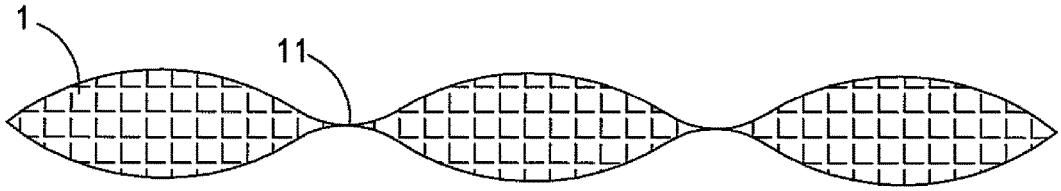
FIG. 2 is a schematic view showing the way of forming nodes in the present invention.
Figure 3:
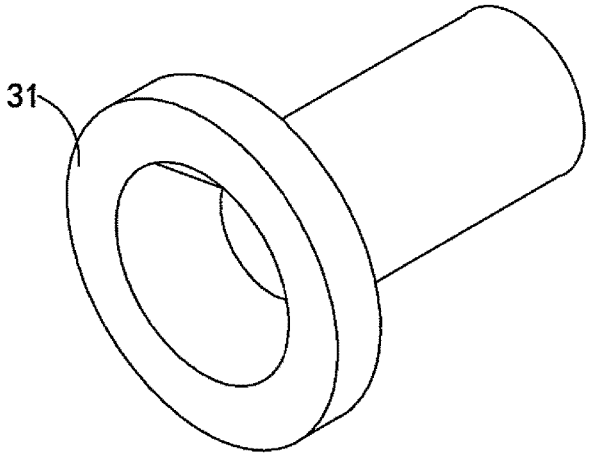
FIG. 3 is a schematic view showing use of air nozzle for forming nodes in the present invention.

With reference to FIGS. 1 to 3, the structure of the present invention will be described herein.

A roll of yarns 1 is a spindle winding by many circles of yarns. The spindle has a hollow center which serves to be received a shaft of a spindle frame. The yarns 1 are selected from one of polyester false twisting yarns, polyester nylons yarn, polyester nylon short fibers, polyester and cotton mixing yarns.

A first roller 2 serves to transfer the yarn 1 with a speed of 100-1000 meters per minute to proceed operation process.

A node generator 3 installed behind the first roller 2 for forming nodes 11 on the yarn 1 with an air nozzle 31 so that yarn fibers are compressed tightly in the node sections. High pressure air is sprayed into the nozzle to form turbulent flow for forming the nodes so that the yarn has uniform physical properties. This is beneficial to the following operation.

In forming nodes on the polyurethane (PU) or polyester or polyamide yarns, an air nozzle 31 causes the yarn to compress as a narrow beam and wind them together. There are 80 to 120 nodes per meters of the yarns.

A cleaning chamber 4 is installed after the node generator 3 for cleaning the yarn after forming the nodes with clean water for removing oils left on the yarn. The yarn may pass through or be sprayed by water for cleaning so that the original yarns are cleaned in the succeeding process.

A material adding chamber 5 stores additive materials 51 which will be added to the cleaned yarn 1. The additive material may be at least one of xylitol, spirooxazines dye, 6'-(diethylamino)-1',3'-dimethyl_uoran (which is also called as spiro [isobenzofuran-1 (3H), 9'-[9H]xanthen]-3-one, 6'-(diethylamino)-1', 3'-dimeth (CAS No. 21934-68-9) lactone dyes, (1-hexadecanol, CAS No. 36653-82-4) and melamine, CAS No. 108-78-1. If the additive 51 is formed by mixing xylitol and high molecular polymer (acrylic or polyurethane (PU) or polyester), the size of xylitol powders is several millimeters. The additive is mixed powders of xylitol and high molecular polymer which are heat-absorbed, in that the xylitol has a ratio of 6 to 12 weight or volume percentages and the high molecular polymer has a ratio of 88 to 94 weight or volume percentages. The additives in the material adding chamber 5 has liquid form so that when the yarn 1 passes through the additives 51, the yarn 1 is enclosed by the additives 51.

The additive is mixed powders of spirooxazines dye and high molecular polymer which are color changed due to light radiation, in that the spirooxazines dye has a ratio of 6 to 12 weight or volume percentages and the high molecular polymer has a ratio of 88 to 94 weight or volume percentages.

Or the additive contains high molecular polymer and at least one of 6'-(diethylamino)-1',3'-dimethyl_uoran (also called as spiro[isobenzofuran-1(3H), 9'-[9H]xanthen]-3-one, 6'-(diethylamino)-1', 3'-dimeth (CAS No. 21934-68-9) lactonic dyes, 1-hexadecanol, CAS No. 36653-82-4 and melamine (CAS No. 108-78-1) which are color changed due to temperature variation, in that the color changed material has a ratio of 6 to 12 weight or volume percentages and the high molecular polymer has a ratio of 88 to 94 weight or volume percentages.

A second roller set 6 is installed after the material chamber 5 for extending the yarn beam 1 passing through the node generator 3, the cleaning chamber 4 and the material chamber. The second roller 6 could extend the yean beam with a speed of 100 meter to 1000 meter per minutes to that the yarn beam 6 is extended extremely.

A heating chamber is installed after the second roller for fixing the additive material 51 to each fiber of the yarns firmly. The temperature of the heating chamber 7 is between 100 to 600 degree C.

A third roller 8 is installed after the heating chamber 7. The yarn passes through the heating chamber 7 will be heated. The rotation of the third roller 8 causes the yarn passing therethrough with a speed of 100 to 1000 meters per minutes. Furthermore, the yarn 1 passed through the heating chamber 7 is warmed under temperature of 100 to 600 degree C.

A fourth roller 9 is installed after the third roller 8 for shaping the yarns are wound to have desire shapes with an processing speed of 100 to 1000 meters.

Figure 4:
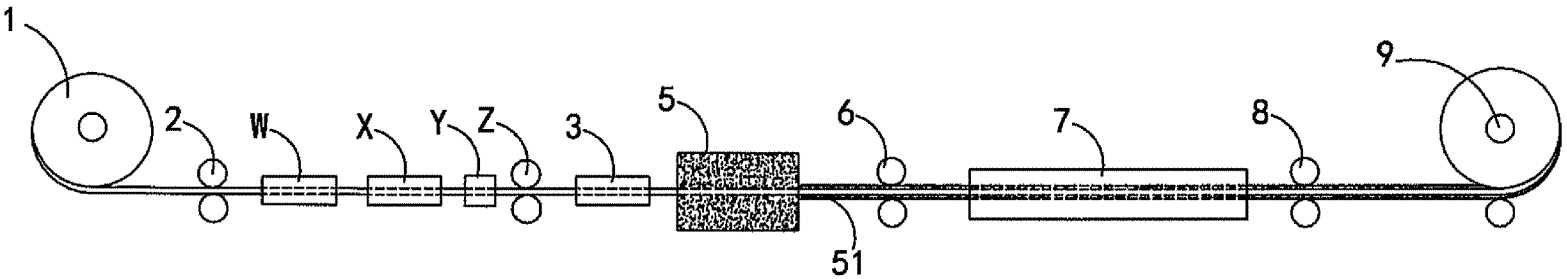
FIG. 4 is another schematic view showing another structure for forming the process of the present invention.

As illustrated in FIG. 4, when the yarns of the raw material 1 are polyester material yarns (POY—partially oriented yarn or FDY—fully drawn yarn) or nylon material yarns (POY or NFDY—non-fully drawn yarn), a second heating chamber W is added after the first roller 2. The temperature of the second heating chamber W is between 100 degree C. to 600 degree C. Then a cooling plate X is installed after the heating chamber W for causing the yarns are heat-shaped in false twisting state. The cooling plate X between the output of the front heating chamber W and the false twisting device Y is has a length of 0.5 to 1.5 meters. After the yarns are released from the false twisting state, the temperature is below 100° C. so that the shaping operation can be performed conveniently. A false twisting device Y is installed after the cooling plate X and an extension rollers Z is installed after the false twisting device Y for extension of the yarns passing through so that the polyester material yarns and nylon material yarns may become processed yarns.

Yarns processed from above procedures have the property of additives added thereon. When the yarns are made as clothes, in dying process, the properties of the additives including heat absorption, color change due to light or temperature variation will be presented so that these properties will present in the clothes made of the yarns so that people wearing the clothes will feel cool, or feel color change due to light or temperature variations.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An apparatus for processing yarns, comprising:

a first roller set for extending yarn beam;

a node generator installed after the first roller set for forming node section of the yarn beam;

a first cleaning chamber installed after the node generator for cleaning the yarn beam;

a material chamber for adding additive to the yarn beam;

a second roller set installed after the material chamber for extending the yarn beam;

a first heating chamber installed after the second roller set for thermally setting additives to the yarn beam so that the additives are firmly secured to the yarn of the yarn beam;

a third roller set installed after the heating chamber for controlling the heating time of the yarn beam in the first heating chamber; and a fourth roller set installed after the third roller set for winding the yarn beam.

2. The apparatus for processing yarns as claimed in claim 1, wherein the yarns in the yarn beam is one of polyester false twisting yarns, polyester nylons yarns, polyester nylon short fibers, polyester and cotton mixing yarns.

3. The apparatus for processing yarns as claimed in claim 1, wherein the first roller set is configured to control the yarn beam to pass therethrough with a speed of 100 meters to 1000 meter per minute.

4. The apparatus for processing yarns as claimed in claim 1, wherein the node generator includes an air nozzle for yarn beam of polyurethane (PU) or polyester so that the yarn beam is wound and compressed to form node sections; where each meter of yarn beam has 80 to 120 nodes.

5. The apparatus for processing yarns as claimed in claim 1, wherein the material chamber is configured to supply the additives which comprises high molecular polymer.

6. The apparatus for processing yarns as claimed in claim 5, wherein the high molecular polymer is acrylic or polyurethane (PU) or polyester.

7. The apparatus for processing yarns as claimed in claim 1, wherein the material chamber is configured to supply the additives, the additive is mixed powders of xylitol and high molecular polymer which are heat-absorbed, in that the xylitol has a ratio of 6 to 12 weight or volume percentages and the high molecular polymer has a ratio of 88 to 94 weight or volume percentages.

8. The apparatus for processing yarns as claimed in claim 1, wherein the material chamber is configured to supply the additives, the additive is mixed powders of spirooxazines dye and high molecular polymer which are color changed due to light radiation, in that the spirooxazines dye has a ratio of 6 to 12 weight or volume percentages and the high molecular polymer has a ratio of 88 to 94 weight or volume percentages.

9. The apparatus for processing yarns as claimed in claim 1, wherein the second roller set is configured to control the yarn beam and to cause the yarn beam to pass therethrough with a speed of 100 meter to 1000 meter per minutes.

10. The apparatus for processing yarns as claimed in claim 1, wherein the heating temperature of the heating chamber is between 100 to 600 degree C.

11. The apparatus for processing yarns as claimed in claim 1, wherein the third roller set is configured to control the yarn beam and to cause the yarn beam to pass therethrough with a speed of 100 meter to 1000 meter per minutes for controlling the heating time of the heating chamber.

12. The apparatus for processing yarns as claimed in claim 1, wherein the fourth roller set is configured to control the yarn beam and to cause the yarn beam to pass therethrough with a speed of 100 meter to 1000 meter per minutes for winding and shaping the yarn beam.

13. The apparatus for processing yarns as claimed in claim 1, wherein when the yarns of raw material are one of polyester material yarns (POY or FDY), or nylon material yarns (POY or NFDY), a second heating chamber is added after the first roller; and then a cooling plate is installed after the heating chamber, and a false twisting device is installed after the cooling plate for causing the polyester material yarns and nylon yarns become processed yarns.

* * * * *